US008459415B2

(12) United States Patent
Kwon et al.

(10) Patent No.: US 8,459,415 B2
(45) Date of Patent: Jun. 11, 2013

(54) ELEVATOR MOTION PROFILE CONTROL INCLUDING NON-INSTANTANEOUS TRANSITION BETWEEN JERK VALUES

(75) Inventors: YiSug Kwon, Farmington, CT (US); Daryl J. Marvin, Farmington, CT (US); Steven D. Coste, Berlin, CT (US); Randall Keith Roberts, Hebron, CT (US)

(73) Assignee: Otis Elevator Company, Farmington, CT (US)

( * ) Notice: Subject to any disclaimer, the term of this patent is extended or adjusted under 35 U.S.C. 154(b) by 251 days.

(21) Appl. No.: 12/992,109

(22) PCT Filed: Aug. 4, 2008

(86) PCT No.: PCT/US2008/072069

§ 371 (c)(1), (2), (4) Date: Nov. 11, 2010

(87) PCT Pub. No.: WO2010/016826

PCT Pub. Date: Feb. 11, 2010

(65) Prior Publication Data

US 2011/0073414 A1 Mar. 31, 2011

(51) Int. Cl.
*B66B 1/28* (2006.01)

(52) U.S. Cl.
USPC ..... 187/295; 187/247

(58) Field of Classification Search
USPC ..... 187/247, 277, 287, 289, 290, 293, 187/296, 297, 295
See application file for complete search history.

(56) References Cited

U.S. PATENT DOCUMENTS

| | | | | |
|---|---|---|---|---|
| 3,523,232 | A | 8/1970 | Hall et al. | |
| 3,774,729 | A | 11/1973 | Winkler | |
| 4,155,426 | A | 5/1979 | Booker, Jr. | |
| 4,751,984 | A * | 6/1988 | Williams et al. | 187/293 |
| 5,035,301 | A * | 7/1991 | Skalski | 187/295 |
| 5,241,141 | A * | 8/1993 | Cominelli | 187/295 |
| 5,325,036 | A * | 6/1994 | Diethert et al. | 318/802 |
| 5,378,861 | A * | 1/1995 | Barten et al. | 187/316 |
| 5,424,498 | A * | 6/1995 | Spielbauer et al. | 187/292 |
| 5,859,395 | A * | 1/1999 | Fargo | 187/316 |

(Continued)

FOREIGN PATENT DOCUMENTS

| | | |
|---|---|---|
| EP | 1138868 A1 | 10/2001 |
| EP | 1731467 A1 | 12/2006 |

(Continued)

OTHER PUBLICATIONS

International Search Report and Written Opinion of the International Searching Authority for International application No. PCT/US2008/072069 mailed May 18, 2009.

(Continued)

*Primary Examiner* — Anthony Salata
(74) *Attorney, Agent, or Firm* — Carlson, Gaskey & Olds PC

(57) ABSTRACT

An exemplary device for controlling an elevator car motion profile includes a controller (64) that is programmed to cause an associated elevator car (62) to move with a motion profile that includes a plurality of jerk values (78, 82, 86, 90, 96, 100). The controller (64) is programmed to cause at least one transition (84, 88, 94, 98) between two of the jerk values to be at a non-instantaneous transition rate.

18 Claims, 2 Drawing Sheets

U.S. PATENT DOCUMENTS

| | | | | |
|---|---|---|---|---|
| 6,311,802 | B1 * | 11/2001 | Choi et al. | 187/293 |
| 7,011,184 | B2 * | 3/2006 | Smith et al. | 187/281 |
| 7,208,898 | B2 * | 4/2007 | Stoecker et al. | 318/561 |
| 2007/0227828 | A1 | 10/2007 | Kinpara et al. | |
| 2012/0111670 | A1 * | 5/2012 | Fargo et al. | 187/247 |

FOREIGN PATENT DOCUMENTS

| | | | |
|---|---|---|---|
| GB | 2173321 | A | 10/1986 |
| JP | 2007076824 | A | 3/2007 |
| SU | 1645236 | A2 | 4/1991 |
| WO | 2009019322 | A1 | 2/2009 |

OTHER PUBLICATIONS

International Preliminary Report on Patentability for International application No. PCT/US2008/072069 mailed Feb. 17, 2011.

* cited by examiner

ELEVATOR MOTION PROFILE CONTROL INCLUDING NON-INSTANTANEOUS TRANSITION BETWEEN JERK VALUES

BACKGROUND

Elevator systems are useful for carrying passengers, cargo or both between various levels within a building, for example. There are various considerations associated with operating an elevator system. For example, there is a desire to provide efficient service to passengers. One way in which this is realized is by controlling the flight time of an elevator car as it travels between levels in a building. There are practical constraints on an elevator flight time dictated by the machinery used for moving the elevator and the desire to provide a certain level of ride quality. For example, passengers would feel uncomfortable if the elevator car accelerated or decelerated at certain rates. Therefore, ride comfort constraints are implemented to ensure that passengers have a comfortable ride.

There are competing considerations when attempting to maximize the traffic handling capacity of an elevator system (i.e., to minimize flight time) and to maximize the ride comfort of passengers. Adjusting the control parameters in one direction to decrease the flight time typically results in a decrease in ride quality. Conversely, adjusting control parameters to increase ride quality usually causes a sacrifice of efficiency in terms of flight time.

For example, an elevator control arrangement typically dictates a motion profile of the elevator car that sets limits on velocity, acceleration and jerk. When vibration levels in an elevator car are too high, the typical approach is to reduce the values of the jerk, acceleration, velocity or a combination of these. Attempting to minimize vibration and improve ride quality, however, typically increases the associated flight time. To maintain a comfortable ride, conventional wisdom has been to decrease acceleration, for example to provide improved ride quality. Unfortunately, however, decreased acceleration increases the flight time for a particular elevator run, which may prove inconvenient or inefficient in terms of performance. If the goal is to avoid an increase in flight time while decreasing acceleration in an attempt to improve passenger comfort, there typically will be an associated increase in jerk rate. Introducing higher amounts of jerk, however, results in higher amounts of vibration in the elevator car which defeats the reason for decreasing acceleration in the first place (e.g., to improve ride quality or passenger comfort).

FIG. 1 shows a typical elevator motion profile 20. A first plot 22 represents the position of the elevator car during a single run from an initial position to a selected landing at a scheduled stop. The velocity of the elevator car is shown at 24. An associated acceleration curve is shown at 26. The example of FIG. 1 includes a plot 28 showing jerk values during the elevator run. In this example, the jerk value begins at 30 and is instantaneously changed at 32 to a maximum value shown at 34. At the same time (e.g., at 32) the elevator car acceleration begins in this example. Once the acceleration reaches a constant level, the amount of jerk is instantaneously changed at 36 back down to a zero value shown at 38. As the elevator car continues to move in this example, the distance remaining to the intended landing warrants initiation of a stopping sequence. This causes the jerk to change instantaneously at 40 to the level at 42, which in turn causes the acceleration to begin to decrease. As the elevator car approaches the intended landing, the jerk rate at 42 is maintained until the acceleration rate crosses through zero value and becomes the negative of the value achieved at 36. This causes an instantaneous change in jerk at 44. As the elevator car approaches the landing, there is an instantaneous change in the jerk value at 46 back to a maximum value shown at 48 and finally an instantaneous change at 50 back down to a zero value.

As can be appreciated from FIG. 1, a typical elevator motion profile includes a generally square-wave shaped jerk profile. Setting appropriate limits on the acceleration, velocity and jerk allows for controlling the ride comfort for passengers on such an elevator run.

It would be useful to be able to control an elevator motion profile in a way that provides a desired level of ride quality without sacrificing performance by increasing flight time, for example.

SUMMARY

An exemplary device for controlling an elevator car motion profile includes a controller that is programmed to cause an associated elevator car to move with a motion profile that includes a plurality of jerk values. The controller is programmed to cause at least one transition between two of the jerk values to be at a non-instantaneous transition rate.

In one example, the controller is programmed to cause a transition between two of the jerk values to be at a first transition rate that is different than a second transition rate between two of the jerk values at another time in the motion profile.

An exemplary method of controlling an elevator car motion profile includes causing an elevator car to move with a motion profile that includes a plurality of jerk values. At least one transition between two of the jerk values is controlled to be at a non-instantaneous transition rate.

In one example, transitioning between two of the jerk values occurs at a first transition rate for a portion of the motion profile and a second transition rate between two of the jerk values for another portion of the motion profile.

The various features and advantages of the disclosed examples will become apparent to those skilled in the art from the following detailed description. The drawings that accompany the detailed description can be briefly described as follows.

DETAILED DESCRIPTION

Figure 2:
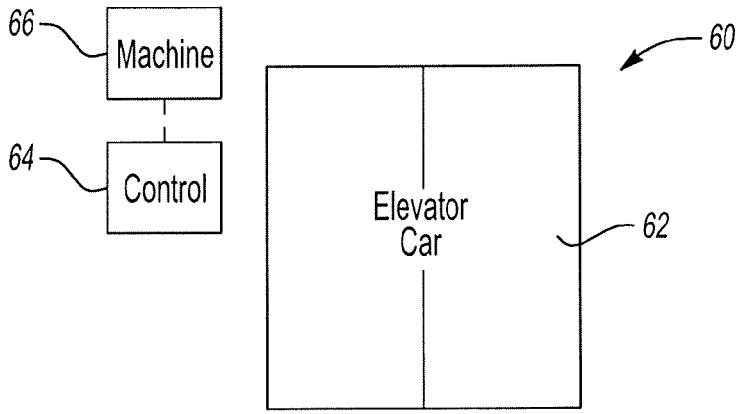
FIG. 2 schematically illustrates selected portions of an example elevator system.

FIG. 2 schematically shows selected portions of an elevator system 60. An elevator car 62 is supported for movement within a hoistway, for example. A controller 64 is programmed to control operation of a machine 66 to achieve desired movement of the elevator car 62. The controller 64 is programmed to cause the elevator car 62 to move with a motion profile that includes a plurality of jerk values. The controller 64 is programmed to cause at least one transition between two of the jerk values to be at a non-instantaneous transition rate. Controlling the transitions between different jerk values in this example provides a reduced amount of vibration in the elevator car 62 to improve ride quality. At the same time, the flight time for an elevator run is not lengthened by using a non-instantaneous transition rate between different jerk values.

Figure 3:
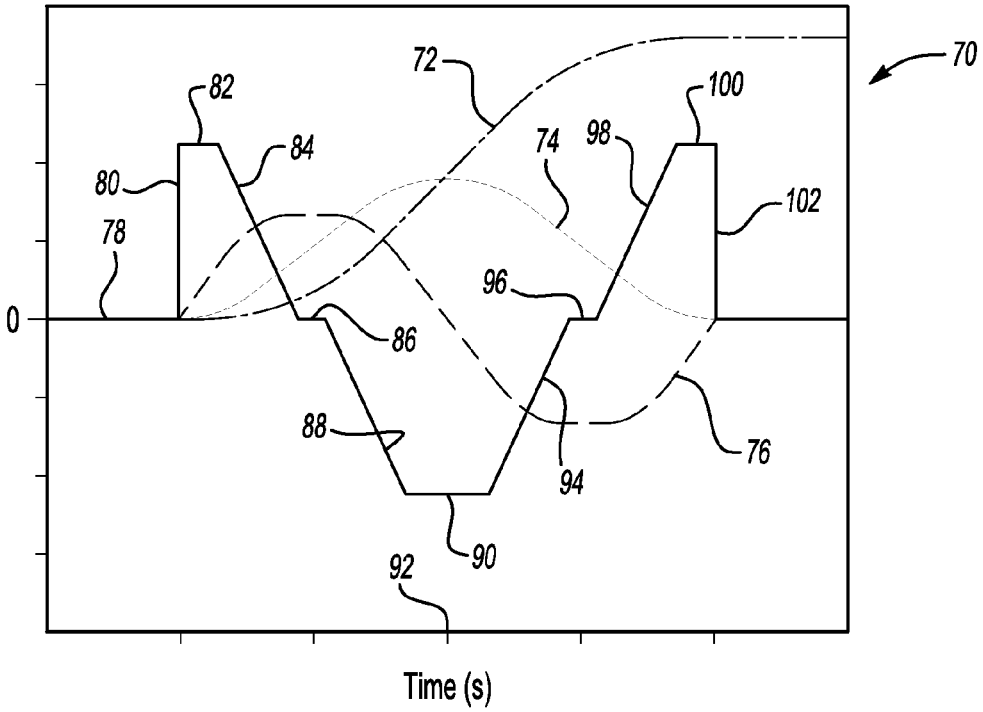
FIG. 3 schematically illustrates an example elevator motion profile designed according to an embodiment of this invention.

FIG. 3 schematically shows an elevator motion profile 70. The motion profile is achieved by the controller 64 generating commands for controlling the machine 66, for example. A plot 72 shows the change in position of the elevator car 62 during a single run between an initial position and a scheduled stop, for example. A curve 74 shows the velocity of the elevator car during the same run. Another curve 76 shows the associated acceleration.

The jerk values for the example motion profile 70 begin at 78, which corresponds to a time before the elevator car 62 begins to move. At 80 there is an instantaneous transition to a maximum jerk value shown at 82. In this example, the instantaneous transition at 80 corresponds to the beginning of elevator car movement. The jerk value remains at the maximum value shown at 82 while the change in the acceleration rate 76 (i.e., the slope) remains relatively constant.

A point is reached where continuing at the jerk rate at 82 would cause the acceleration to exceed its imposed limit. The jerk transition at 84 is imposed by the controller 64 causing the jerk to change from the jerk rate at 82 to a lower value at 86. In this example, the value at 86 corresponds to a zero jerk value. The transition rate at 84 is non-instantaneous. As can be appreciated from FIG. 3, the slope at 84 is oblique to a purely vertical line and the transition between the jerk values shown at 82 and 86 occurs over time. Using a non-instantaneous transition rate at 84 reduces an amount of vibration associated with the change in jerk value.

In the example of FIG. 3, the zero jerk value at 86 continues for a time and then there is another transition shown at 88 down to a negative jerk value shown at 90. The transition at 88 occurs at a non-instantaneous transition rate. In some examples, the transition rate at 84 is the same as the transition rate at 88. In other examples, different transition rates are used at the areas indicated at 84 and 88 in the example of FIG. 3. Both transition rates shown at 84 and 88 are different than the transition rate shown at 80. The transition rates at 84 and 88 are both less than the instantaneous transition rate shown at 80.

A midpoint 92 of the motion profile 70 is schematically shown in FIG. 3. The midpoint 92 occurs while the car 62 moves at a maximum or a contract speed during the run, for example. The motion profile 70 shown in FIG. 3 contains a mirror image on each side of the midpoint 92. A transition rate shown at 94 between the jerk values shown at 90 and 96 corresponds to the transition rate 88, for example. A transition rate 98, between jerk values shown at 96 and 100, corresponds to the transition rate 84. The minor-image symmetry is not required, as the slope of jerk may vary naturally. A maximum jerk value shown at 100 is associated with the elevator car 62 stopping at an intended destination. In this example, the jerk value 100 corresponds to that shown at 82. An instantaneous transition from the jerk value 100 occurs at 102 back down to zero as the elevator car 62 comes to a complete stop.

In the example of FIG. 3, the transition rates at 80 and 102 are instantaneous. The non-instantaneous transition rates 84, 88, 94 and 98 are used while the elevator car 62 is in motion during a scheduled run.

Figure 1:
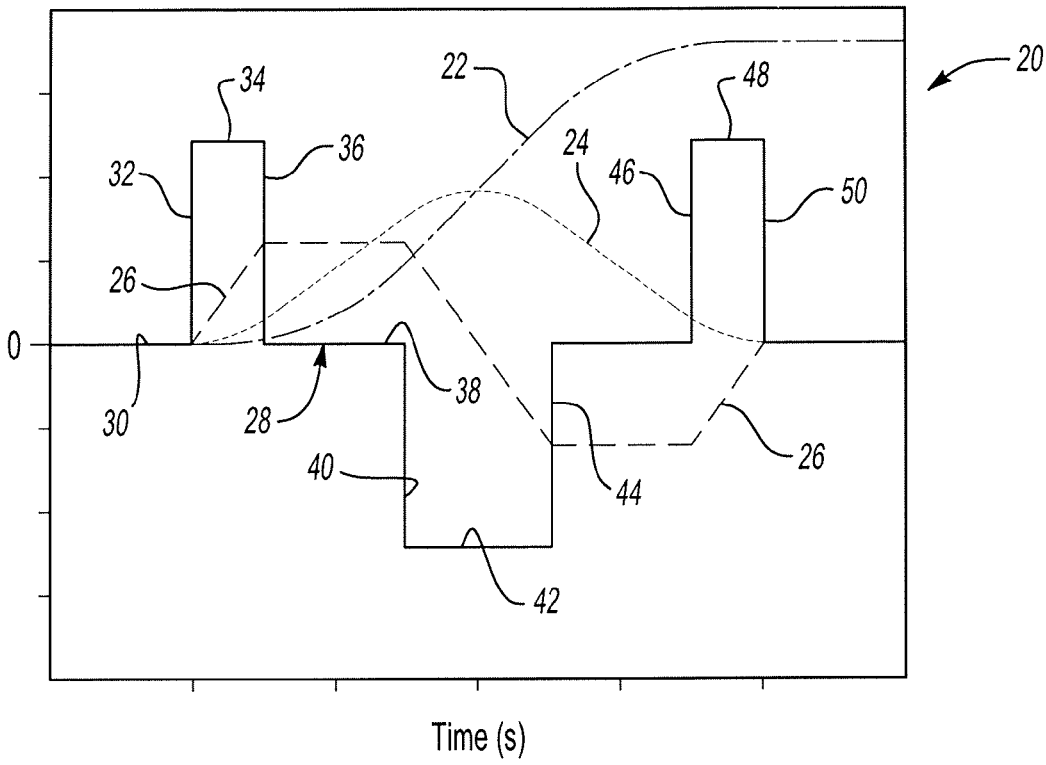
Fig-1 PRIOR ART
FIG. 1 schematically illustrates an elevator motion profile according to the prior art.

One feature of the illustrated example of FIG. 3 is that certain portions of the motion profile can be considered asymmetric in that different transition rates are used on different sides of a particular jerk value. For example, the transition rate at 80 is different than the transition rate at 84, both of which occur on opposite ends of the time during which the jerk value is at 82. This is significantly different than a symmetric arrangement such as the square wave shown in FIG. 1 where the transition rate on opposite ends of the different jerk values are all the same (i.e., an instantaneous transition rate). It is understood that the transition rate at opposite ends of a particular jerk value in other portions of the motion profile may be symmetric, for example where the transition rate at each end (such as 88 and 94 in FIG. 3) is non-instantaneous.

Figure 4:
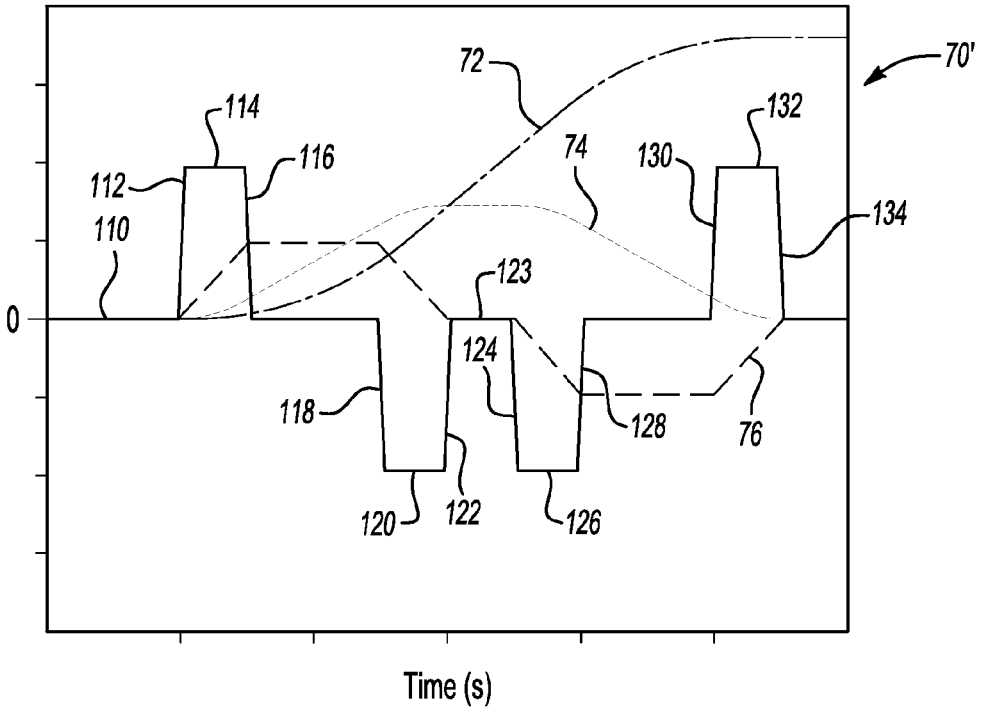
FIG. 4 schematically illustrates another example elevator motion profile.

FIG. 4 shows an example where a non-instantaneous transition rate is used at all transitions in the jerk values for an example elevator motion profile 70'. In the example of FIG. 3, the motion profile 70 includes a jerk profile having vertical transitions at the beginning and end of the illustrated single run of the elevator car 62. Sloped (e.g., non-instantaneous) transitions occur between different jerk values that are between the beginning and end of the elevator car run. In FIG. 4, every transition between different jerk values occurs at a non-instantaneous transition rate (e.g., none of the transition portions of the jerk profile have a truly vertical line).

In the example of FIG. 4, the jerk values begin at 110 and there is a non-instantaneous transition rate up a maximum jerk value shown at 114. This corresponds to the beginning of movement of the elevator car 62, for example. The example of FIG. 4 is different than the example of FIG. 3 in that the transition rate at 112 is non-instantaneous whereas the transition rate at 80 in the example of FIG. 3 is instantaneous (i.e., as represented by a vertical line).

Another transition at 116 occurs between the maximum jerk value at 114 and a zero jerk value. Subsequently during the elevator run, another transition rate is used at 118 down to a minimum jerk value shown at 120. The transition rate at 116 may be the same as the transition rate at 118. A non-instantaneous transition occurs at 122 back up to a zero jerk value. In this example, the midpoint 123 of the motion profile 70' occurs when there is a zero acceleration value and a zero jerk value. A transition rate at 124 occurs until the jerk value reaches a minimum at 126.

Another non-instantaneous transition rate occurs at 128 and at 130. Near the end of the elevator run, a maximum jerk occurs at 132 and there is a non-instantaneous transition rate at 134 back to a zero jerk value.

In the example of FIG. 4, like the example of FIG. 3, the motion profile 70' is symmetric with respect to its midpoint 123. In some examples, the motion profile need not be symmetric in terms of both the transition rates and the times along the run of the car at which such rates change.

In some examples, the non-instantaneous transition rates are constant. In some examples, the transition rate varies during a transition between two of the jerk values (e.g., an at least partially curved line represents the jerk during such a transition).

One feature of the illustrated examples is that controlling a transition rate of jerk allows for selecting a particular level of ride quality. The non-instantaneous transition rates used for changing between different jerk values do not excite elevator hoistway dynamics during acceleration and deceleration times, which can provide improved ride quality. In one example, an approximately 20% reduction in vibration level is achievable using a non-instantaneous transition rate between different jerk values.

By controlling jerk and acceleration as shown in the above examples, the rate of application of force on the elevator system can be controlled. Controlling jerk to obtain smoother acceleration provides improved ride quality by "pushing" on the system rather than "jerking" it around. In other words, non-instantaneous transitions between jerk values provides smoother acceleration and lower resulting vibration. With the discussed examples, higher ride comfort and quality is achievable without increasing the amount of time it takes to complete a run.

At the same time, the illustrated examples do not require lengthening the flight time by reducing the maximum acceleration or jerk values, for example. With the illustrated examples, it is possible to achieve a desired ride quality within a desired flight time. It is possible to maintain a desired level of ride quality and improve flight time.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A device for controlling an elevator car motion profile, comprising:

a controller that is programmed to cause an associated elevator car to move with a motion profile that includes a plurality of jerk values, the controller being programmed to cause at least one transition between two of the jerk values to be at a non-instantaneous transition rate.

2. The device of claim 1, wherein the controller is programmed to cause a first transition between two of the jerk values to be at a first transition rate that is different than a second transition rate during a second transition between two of the jerk values.

3. The device of claim 2, wherein the controller is programmed to cause the first and second transition rates during a single run of the associated elevator car between a beginning location and a scheduled stop.

4. The device of claim 2, wherein the first transition rate is faster than the second transition rate.

5. The device of claim 4, wherein the first transition rate is instantaneous.

6. The device of claim 2, wherein at least one of the first or second transition rates is constant.

7. The device of claim 1, wherein the motion profile includes a jerk profile having a vertical transition at a beginning and an end of a single run of the associated elevator car and has sloped transitions between different jerk values occurring between the beginning and end of the run.

8. The device of claim 1, wherein a portion of the motion profile between a beginning of a single run and a midpoint of the run is asymmetric.

9. The device of claim 8, wherein another portion of the motion profile between the midpoint of the run and an end of the run is a minor-image of the portion of the motion profile between the beginning and the midpoint of the run.

10. A method of controlling an elevator car motion profile, comprising the steps of:

causing an elevator car to move with a motion profile that includes a plurality of jerk values; and transitioning between two of the jerk values at a non-instantaneous transition rate.

11. The method of claim 10, comprising transitioning between two of the jerk values at a first transition rate that is different than a second transition rate between two of the jerk values.

12. The method of claim 11, comprising using the first and second transition rates during a single run of an elevator car between a beginning location and a scheduled stop.

13. The method of claim 11, wherein the first transition rate is faster than the second transition rate.

14. The method of claim 13, wherein the first transition rate is instantaneous.

15. The method of claim 11, wherein at least one of the first or second transition rates is constant.

16. The method of claim 10, wherein the motion profile includes a jerk profile having a vertical transition at a beginning and an end of a single run of an elevator car, the jerk profile including sloped transitions between different jerk values occurring between the beginning and end of the run.

17. The method of claim 10, comprising controlling the motion profile to be asymmetric between a beginning of a single run of an elevator car and a midpoint of the run.

18. The method of claim 17, comprising controlling the motion profile between the midpoint of the run and an end of the run to be a mirror-image of the portion of the motion profile between the beginning and the midpoint of the run.

* * * * *